United States Patent [19]

Heiser et al.

[11] 4,291,618

[45] Sep. 29, 1981

[54] METHOD AND APPARATUS FOR FOLDING AND CRUSHING EMPTY CYLINDRICAL CANS

[75] Inventors: Warren R. Heiser, 934 N. Mildred St., Dearborn, Mich. 48128; Eugene A. Acey, Davisburg, Mich.

[73] Assignee: Warren R. Heiser, Dearborn, Mich.

[21] Appl. No.: 82,142

[22] Filed: Oct. 5, 1979

[51] Int. Cl.[3] ..... B30B 1/04; B30B 9/32

[52] U.S. Cl. ..... 100/35; 100/99; 100/102; 100/216; 100/218; 100/266; 100/283; 100/292; 100/295; 100/902; 101/4; 101/17

[58] Field of Search ..... 241/99; 100/35, 102, 100/DIG. 2, 215, 216, 218, 266, 295, 99, 292, 40, 282, 283; 101/4, 17

[56] References Cited

U.S. PATENT DOCUMENTS

| | | | |
|---|---|---|---|
| 2,638,957 | 5/1953 | Danielson | 100/DIG. 2 |
| 2,737,995 | 3/1956 | Jennings | 100/DIG. 2 |
| 2,773,536 | 12/1956 | Lange | 100/DIG. 2 |
| 2,958,273 | 11/1960 | Morrow | 100/DIG. 2 |
| 2,982,200 | 5/1961 | Robertson | 100/DIG. 2 |
| 3,095,806 | 7/1963 | Mirkovich | 100/DIG. 2 |
| 3,106,888 | 10/1963 | Chapleau | 100/DIG. 2 |
| 3,374,730 | 3/1968 | Cain | 100/DIG. 2 |
| 3,667,386 | 6/1972 | Workman | 100/DIG. 2 |
| 3,732,804 | 5/1973 | Moller | 100/DIG. 2 |
| 3,832,941 | 9/1974 | Moller | 100/DIG. 2 |
| 3,916,780 | 11/1975 | Heiser | 100/DIG. 2 |
| 3,988,978 | 11/1976 | Flick | 100/35 |
| 4,062,283 | 12/1977 | Kaminski | 100/218 |
| 4,133,261 | 1/1979 | Belfils | 100/DIG. 2 |

FOREIGN PATENT DOCUMENTS

| | | | |
|---|---|---|---|
| 2011302 | 7/1979 | United Kingdom | 100/215 |

*Primary Examiner*—Billy J. Wilhite

*Attorney, Agent, or Firm*—Hauke and Patalidis

[57] ABSTRACT

An apparatus and method for folding and crushing empty cylindrical cans such that after being folded and crushed the can end faces are essentially coplanar. The apparatus comprises a flat stationary anvil and a flat parallel reciprocable platen defining therebetween a folding compartment into which an empty can is inserted, an independently reciprocable creasing element or plunger slidably inserted in an aperture through the center of the reciprocable platen such as to enter and leave said folding compartment, and a drive arrangement simultaneously advancing the reciprocable platen and reciprocable creasing element into said folding compartment towards the can, the creasing element being advanced more rapidly than or ahead of the platen, and drive retracting the creasing element after the creasing element has nearly passed through the can without stopping the advance of the platen, and subsequently retracting the platen. The can folder may be manually or power-driven and may be equipped with a digital can counter, an indexing feed means, a gravity-fed disposal chute, and a can marking or branding feature.

23 Claims, 24 Drawing Figures

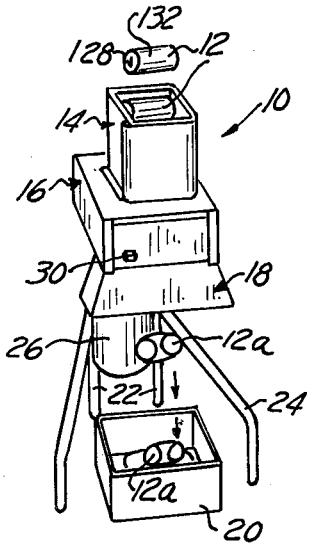
FIG. 1
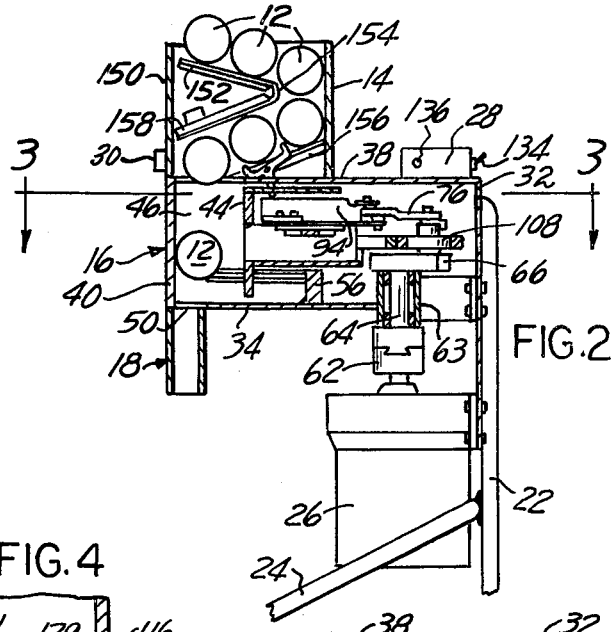
FIG. 2
FIG. 4
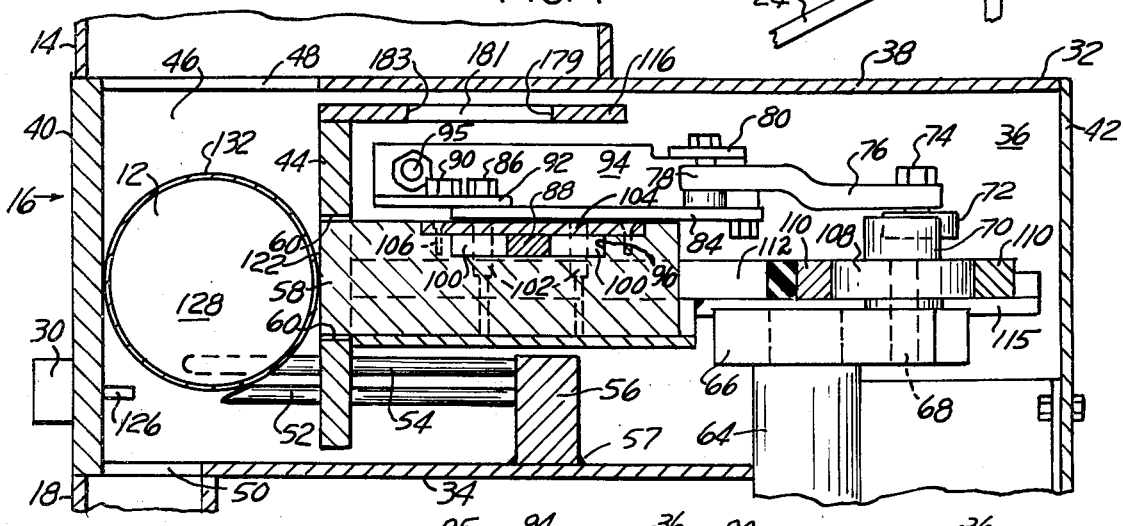
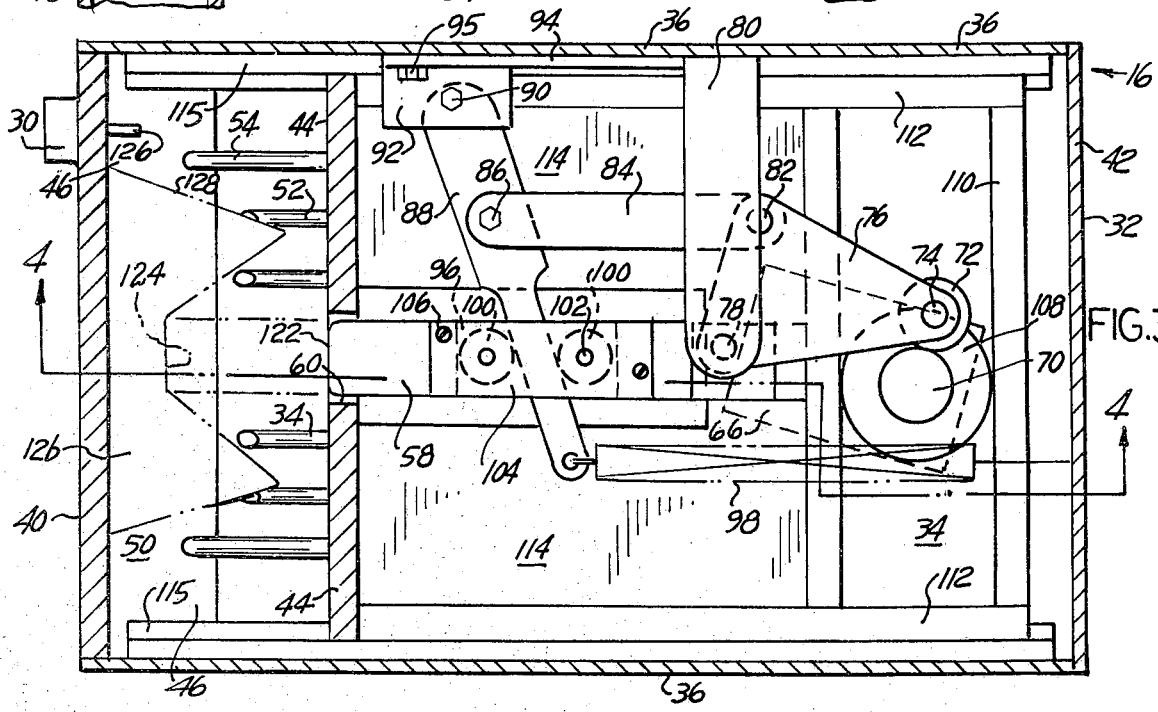
FIG. 3

METHOD AND APPARATUS FOR FOLDING AND CRUSHING EMPTY CYLINDRICAL CANS

BACKGROUND OF THE INVENTION

A considerable number of devices have been devised in the past to crush empty cylindrical cans that previously held beverages, fruits or vegetables, or motor oil, for example. Generally the historical focus has been on crushing the can in the most efficient way possible in terms of cost and effort so that the remnants take up much less space in a garbage bag or a box until they are finally disposed of permanently. However, in recent years, wide-spread concern about the environment has led to the enactment of what has been popularly called "bottle bills" which require manufacturers of soft drinks and beer to charge a deposit on cans as well as on other beverage containers, such as bottles, traditionally subjected to deposits by some manufacturers, so as to encourage the purchaser to return the empty containers to the store rather than discard them. It is believed that the small economic impetus created by the reimbursement of the deposit charge will make the consumer less likely to litter with the empty containers and will help to preserve natural resources by encouraging manufacturers of beverage containers to reuse the containers or recycle the materials of which the containers are made. It is further believed that those beverage containers which are nonetheless thoughtlessly discarded in public places will soon be picked up by children to whom the five to twenty five cents deposit refund looks like a substantial windfall and who are thus eager to return them for the deposit.

Unfortunately, these bottle bills have caused a number of storage and transportation problems. Empty cans and bottles take up as much space as full cans and bottles in the home of the consumer, in the storeroom of a grocery store, and in the cargo compartment of a truck. Thus, the requirement of storing and handling these used containers creates inconvenience for all parties involved and increases overhead expenses by an amount that may greatly exceed the savings resulting from the recycling of the materials. Some pharmacies, fruit markets, and other low volume retailers of beverages have attempted to evade the requirements of the law, for example by refusing to accept large quantities or have completely stopped selling beverages for this reason.

Unlike bottles which may be sterilized and refilled, empty cans must eventually be crushed and their component materials discarded or recycled and thus the costs involved might be prohibitive. However, cans are safer, more compact, lighter, and easier to store than bottles. It would therefore be desirable to encourage the use of cylindrical cans by providing a device which can fold or crush these empty cans so that they will take up a fraction of the space they currently occupy. Merely crushing the cans, however, in a conventional fashion simply will not suffice. Most states currently have no statutory deposit requirements and yet the bottlers use essentially the same designs on their cans across state lines. To avoid fraud, therefore, the cans must be identifiable as deposit cans. Furthermore, the trademark on the side of the can must be identifiable so that the can will be returned to the proper supplier.

Reading the material printed on the ends and on the side of cans is either time-consuming and inconvenient, or even impossible, once the cans have been crushed by most prior art can crushing devices. Devices, for example such as those disclosed in U.S. Pat. Nos. 2,683,957; 3,106,888; 3,374,730 and 3,916,780 which flatten the can in a plane through its longitudinal axis, render the written material on either circular end face of the can unreadable. Yet one of the faces, generally the upper face, is precisely where the deposit information is printed. The same inconveniences exist with the device disclosed in U.S. Pat. No. 3,095,806 in which the can is folded in half after it is flattened. Another method for crushing cans, utilized in devices disclosed in U.S. Pat. Nos. 2,737,995; 2,773,536; 2,958,273; 2,982,200 and 4,133,261 is to squeeze the two end faces of the can towards each other. This is just as unsatisfactory for purposes of the bottle bill because, after the operation is complete, the cylindrical wall is entirely obscured and thus identification of the trademark or the name of the manufacturer or bottler is impossible.

The devices disclosed in U.S. Pat. Nos. 3,732,804 and 3,832,941 come closest to producing a crushed can wherein all the relevant printed matter is identifiable. In these crushers, the can is creased at the center of its cylindrical wall either prior to or during the crushing operation. However, in most of the embodiments disclosed, two separate manual operations are required, the first to crease the can and the second to complete the fold of the can. In the remaining embodiments disclosed, the creasing element is never fully retracted during the crushing operation and thus the printed material on the end faces of the can are partly obstructed. These patents represent the most relevant prior art known to the applicant at the time of filing.

What is needed, therefore, is a can folding and crushing apparatus for use in retail outlets or in homes of consumers to fold and crush cylindrical cans in one quick and smooth operation in a manner such that the folded and crushed can is identifiable as a deposit can and such that the name or tradmark of the manufacturer may be readily determined.

SUMMARY OF THE PRESENT INVENTION

The present invention provides an apparatus for folding and crushing cylindrical cans such that the tradmark or the manufacturer's name and the deposit notice are readable and identifiable and more particularly in a manner such that the upper and lower circular end faces of the folded can are unaltered and aligned in a co-planar retationship. The can folding apparatus of the present invention accomplishes this result by supporting the can between a flat stationary anvil and a flat reciprocable platen, a creasing element being independently reciprocable through an aperture in the center of the reciprocable platen, advancing the creasing element towards the center of the cylindrical sidewall of the can and simultaneously advancing the flattening reciprocable platen towards the can, the former at a faster rate than or ahead of the latter. Once the creasing element has substantially folded the can at its center, it is rapidly retracted, while the reciprocable platen continues its forward advance, thereby completing the fold. The can folder of the present invention may be operated manually or may be driven by power means. It may be provided with an indexing feed chute supplying the cans one at a time into the folding compartment and a gravity-fed disposal chute dropping the folded cans into a receptable. It may further be provided with a can counting mechanism allowing the seller to keep an accurate count of the number of cans returned and a can marking or branding feature such as to permanently label the can as one for which the deposit has already been returned.

The many objects and advantages of the present invention will become apparent to those skilled in the art when the following detailed description of the preferred embodiments is read in accompaniment with the attached drawing wherein like reference numerals refer to like components throughout.

BRIEF DESCRIPTION OF THE DRAWING

FIG. 1 is a perspective view of an example of motor driven can folding apparatus according to the present invention;

FIG. 2 is a partial cross-sectional side view thereof;

FIG. 3 is a cross-sectional view taken along line 3—3 of FIG. 2 showing a top view of the can crushing mechanism;

FIG. 4 is a cross-sectional view taken substantially along line 4—4 of FIG. 3 showing a partial side view of the can crushing mechanism similar to the view in FIG. 2 but at an enlarged scale;

DESCRIPTION OF THE PREFERRED EMBODIMENTS

Figure 5:
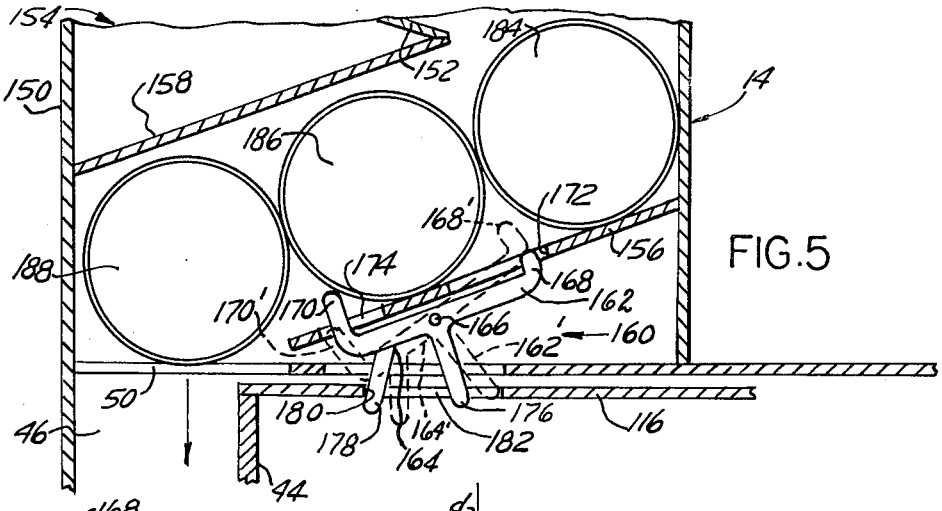
FIG. 5 is a partial cross-sectional side view of the indexing can feed mechanism similar to the view in FIG. 2 but at an enlarged scale.

The present invention relates to can crushing devices and more particularly to can crushing devices for folding and flattening cylindrical deposit beverage cans in a manner preserving the identifiability of the manufacturer and the readability of the deposit denomination on the can. As seen in FIGS. 1 and 2, the present invention contemplates, for example, the use of an automatic power-driven, self-contained, can folding apparatus 10 such as may be used in a retail outlet such as a drugstore, grocery store, restaurant, or bar. In the example of structure shown in FIGS. 1 and 2, described in great detail below, there is a free-standing can folding apparatus 10 accepting cylindrical cans 12 dropped into an indexing feed mechanism 14. The feed mechanism drops one can at a time into the can folding mechanism 16. The crushed cans 12*a* are dropped through a gravity-fed disposal chute 18 into a receptacle 20. The folding apparatus 10 has two vertical rear support legs 22 and two side support legs 24, each mounted at an angle to one of the rear legs. Also shown in FIGS. 1 and 2 are a motor 26, an electrical control box 28 and a digital counter 30.

Focusing first on the internal structure of the can folding mechanism depicted in FIGS. 2–4 of the drawing, the can folding mechanism 16 consists of an outer box or frame 32, having a base 34, two side walls 36, a top panel 38, a front wall 40 and a rear wall 42. The front wall 40, as will become apparent hereinafter, is flat and rigid, and it acts as a stationary platen or anvil during the flattening process, and will therefore be hereinafter referred to simply as the anvil. The anvil 40 and the side walls 36 of the frame 32 together with a substantially flat platen 44 parallel to and reciprocable with respect to the anvil 40 define a can folding compartment or station 46. A large aperture 48 in the top panel 38 and a small aperture 50 in the base 34 permits the unfolded can 12 and the folded can 12*a* to enter and leave the compartment 46 respectively, the cylindrical axis of the can 12 being initially parallel to the anvil 40 and platen 44. Support is provided for the can during the folding operation by means of a number of stationary parallel rods 52 and 54 supporting the bottom and the sides of the can respectively, the rods preferably passing through holes in the platen 44 and being mounted by means of a block 56 fastened, for example, by welds 57, to the base 34. A creasing element shown as a plunger or piston 58 independently reciprocates in and out of the folding compartment 46 passing through a central aperture 60 in the platen 44.

Mounted to the rear legs 22 of the can folder 10 immediately below the can folding mechanism 16 is the motor 26, FIG. 2, driving through a coupling 62, and appropriate gearing, not shown, a main driving and timing shaft 64. The shaft 64 passes through an aperture in the rearward portion of the base 34 of the frame 32 and is appropriately journaled in a bearing, for example as shown at 63. The shaft 64 drives, as best shown at FIG. 3 through a rectangular block 66, an eccentrically mounted stud 68, the head 70 of which in turn engages a roller 72 mounted, by a bolt 74, on one corner of a triangular plate 76. A second corner 78 of the triangular plate 76 is pivotally mounted to the end of a bracket 80 extending from one of the side walls 36 of the frame 32. The third corner 82 of the triangular plate 76 is attached to a link 84 extending forward towards the reciprocable platen 44 and affixed at its end by a bolt 86 to a point along a lever 88 mounted at one end by a bolt 90 to a bracket 92 off the side wall 36 of the frame 32. Brackets 92 and 80 may be part of a single stamping 94 mounted to the side wall 36 by means of at least a bolt 95. The other end of the lever 88 passes through a cavity 96 in the plunger 58 and is secured to an end of a return spring 98 having its other end secured to the rear wall 42 of the frame 32. The lever 88 is constrained within the cavity 96 such as to positively drive the plunger 58 by means of a pair of resilient rollers 100 rotatably secured on stub shafts 102 to the plunger 58, one roller being disposed on each side of the lever 88, and by means of a plate 104 secured above the rollers and the lever, for example by screws 106, covering the top of the cavity 96.

Also mounted on the eccentric block 66, preferably by means of the stud 68 is a roller 108 riding within a rectangular horizontal frame 110 connected, for example, through a pair of posts 112 to the reciprocable platen 44. A pair of horizontal plates 114 may be provided to add rigidity. The assembly consisting of the frame 110, posts 112, plates 114, and reciprocable platen 44 is maintained co-planar by a pair of side anvil guides or tracks 115, one mounted to each side 36 of the frame 32. To the top of the reciprocable platen 44 is welded or otherwise affixed a horizontal plate 116 having a pair of slots parallel to the direction of travel of the platen which may, as will be explained hereinafter, drive the indexing can feed mechanism 14.

Figure 13:
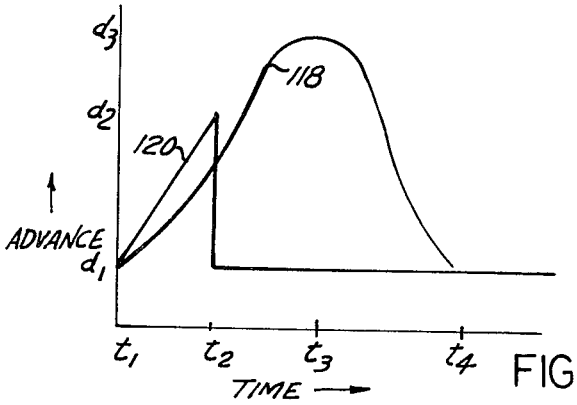
FIG. 13 is a graph depicting the displacement of the reciprocable creasing element and the reciprocable platen into the can folding compartment.
Figure 7:
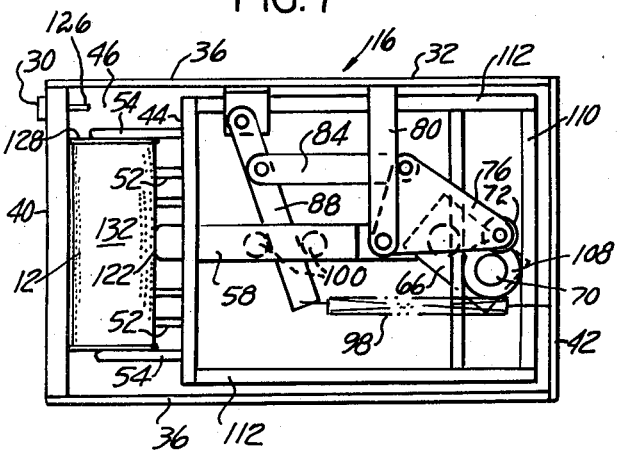
FIGS. 7, 8 and 9 are schematic representations of the can folding mechanism of FIGS. 1–4 shown at three stages during the crushing operation.
Figure 8:
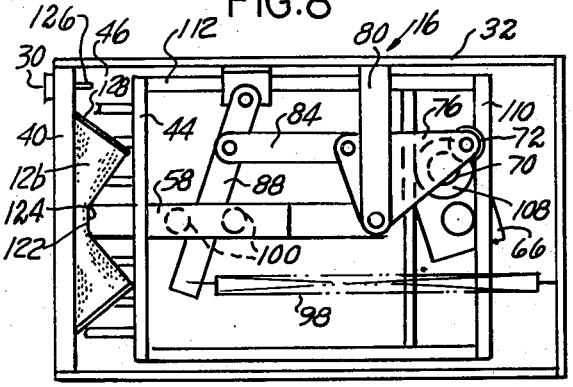
Figure 9:
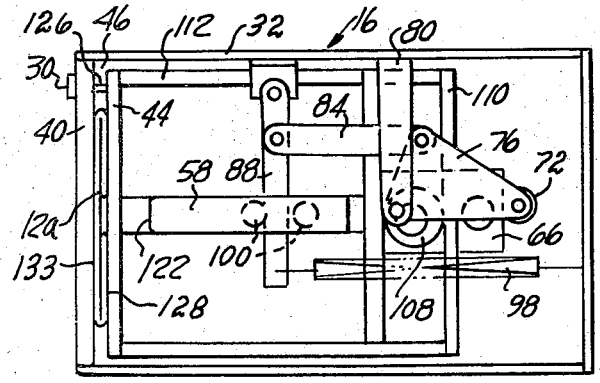

In operation, empty cylindrical cans are placed or fed, into the folding compartment 46 and maintained relatively stationary by means of the anvil 40 and the support rods 52 and 54 FIGS. 3 and 4. FIG. 13 illustrates graphically at curve 118 the amplitude of the motion of the reciprocable platen 44 and at curve 120 the amplitude of the motion of the plunger or piston 58. FIGS. 7–9 depict schematically the orientation of the components of the mechanism 16 at times $t_1$, $t_2$, and $t_3$, respectively. At time $t_1$ the reciprocable platen 44 and the reciprocable plunger 58 are fully retracted, that is, they are in their rest positions $d_1$ shown schematically in FIG. 7 and in solid line in FIGS. 3 and 4. As the motor rotates the drive shaft counterclockwise, the block 66 rotates, driving the roller 108 and the stud 68 in their eccentric orbit about the drive shaft. The head 70 of stud 68 drives the triangular plate 76 through roller 72 which in turn drives the link 84 and the lever 88 and thus drives the plunger 58 into the side of the can 12. The plunger 58 is preferably rectangular in section and thus presents a substantially narrow vertical end face 122 for engagement with the side surface of the can 12 such that, as the plunger 58 advances into the can, it flattens and creases the can, as shown at 124, across its entire central cross-section. Simultaneously, the roller 108 drives the frame 110 which in turn drives the platen 44 towards the can, though at a much slower rate than the plunger 58, such that the can 12 is substantially fully creased at the center prior to the time when the reciprocable platen encounters the edges of the can.

At $t_2$ shown schematically in FIG. 8, and in dotted line in FIGS. 3 and 4, the plunger 58 has advanced nearly through the partly folded can **12*b* to its farthest point of penetration indicated at $d_2$ in FIG. 13. Shortly thereafter, the head 70 of stud 68 rotates out of contact with the roller 72. The lever 88 and thus the plunger 58 are rapidly retracted by the spring 98. A resilient backstop, not shown, may be provided to absorb the shock and the noise caused by the sudden stopping of the pistons' retreat. Meanwhile, the roller 108 continues to drive the reciprocable platen 44 such that the can 12*a* is fully flattened at time $t_3$, depicted schematically at FIG. 9. At this point, the reciprocable platen 44 has moved a distance indicated at $d_3$ in FIG. 13 towards the anvil 40, a distance which may be greater or less than the maximum distance $d_2$ traveled by the plunger 58. Note that at this time, the platen 50 can depress a small plunger or rod 126 passed through the anvil 40 and trigger the digital counter 30** to record one can.

Figure 6:
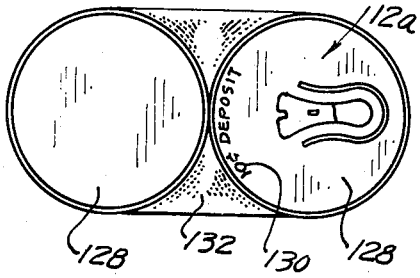
FIG. 6 is a top plan view of a cylindrical can folded according to the present invention.
Figure 19:
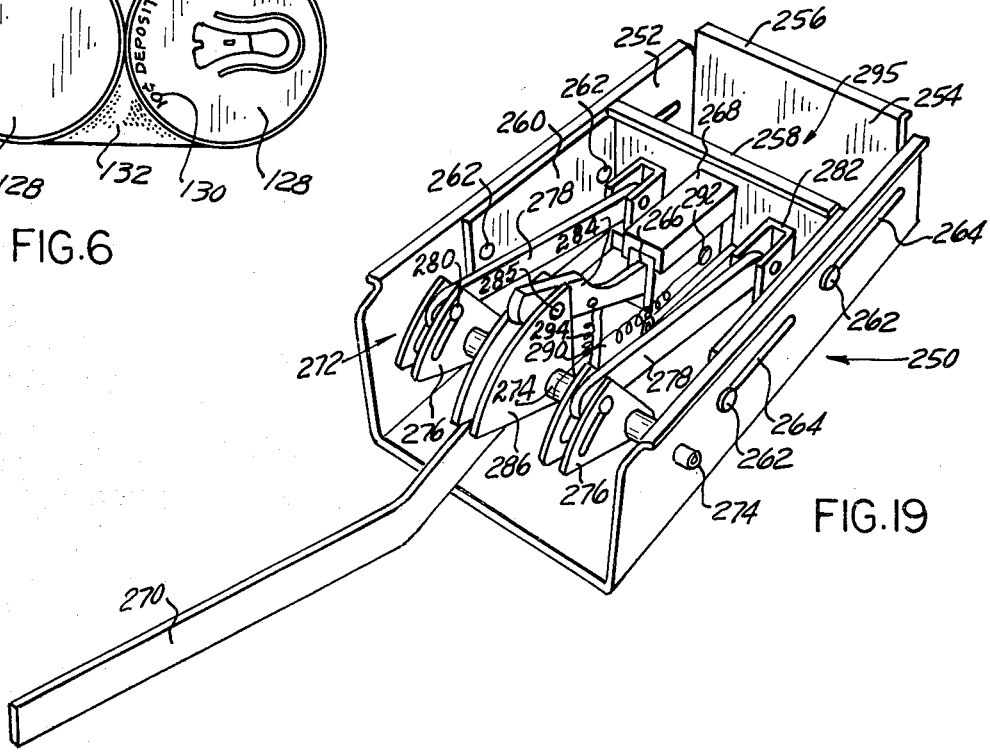
FIG. 19 is a perspective view of an example of a manually operable can folding apparatus according to the present invention.

The end result, as best understood by comparing folded can **12*a* in FIG. 6 with the original can 12 in FIG. 1, will be a folded can 12*a* that is flattened such that the two circular end faces 128 will be substantially intact and parallel and such that all written material such as the deposit legend 130 printed on either end of the can will be readable. On the other side of the now folded can 12*a* will be a sufficiently large and flat portion 133 (FIG. 9) of the previously cylindrical wall 132 such that the manufacturer or trademark may be readily identified. As the motor shaft 64 continues to rotate, the reciprocable platen 44 is retracted away from the stationary platen and the now flattened can 12*a* is free of the support rods 52 and 54 and thus falls through the open slot 50, FIGS. 2 and 4, and the disposal chute 18 into the receptacle 20, FIG. 1. The platen 44** fully retracts to the rest position $d_1$, at which time $t_4$ the machine may be stopped or may stop itself so as not to waste power.

Alternatively, the machine may be run in a continuous mode, as desired, so as to crush a series of cans in a short period of time. Preferably, the control box 28 (FIG. 2) is provided with a three-position switch 134 allowing choice of continuous repetitions of the can folding process or a single cycle as well as a safety light 136 to warn that the power to the motor is turned on.

In the can folding mechanism described hereinbefore, the return spring 98 must exert enough force to rapidly withdraw the piston or plunger 58 from the partly folded can **12*b* (FIGS. 3 and 8). The motor 26, therefore, is working not only against the can to be folded but against the spring 98 as well. An alternative structure wherein the piston is positively retracted by the drive mechanism 26 rather than being retracted by a spring is illustrated at FIGS. 10–12**.

Figure 10:
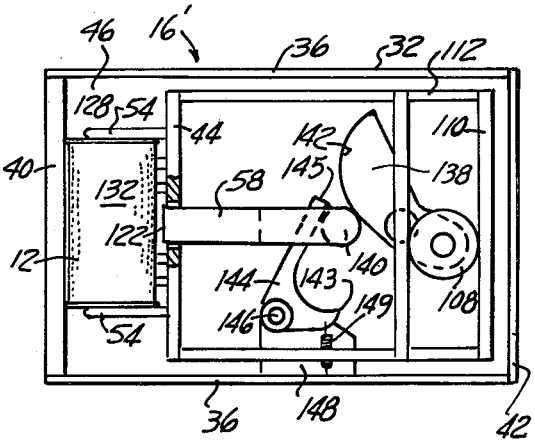
FIGS. 10, 11 and 12 are schematic views similar to FIGS. 7, 8 and 9 respectively showing a variation thereof.
Figure 11:
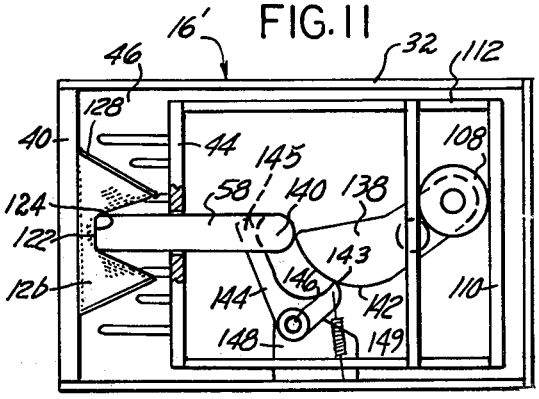
Figure 12:
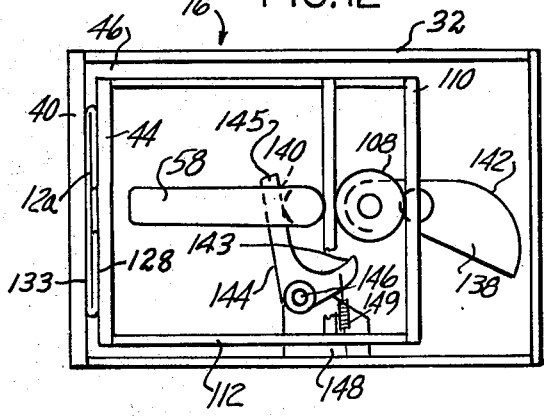

FIGS. 10, 11 and 12 correspond to FIGS. 7, 8 and 9, respectively, but depict schematically a variation of the mechanism for positively driving the reciprocable plunger 58 both into and out of the can. In the folding mechanism 16' of FIGS. 10–12 the plunger or piston 58 is driven by a rotating elongated camming lever 138. The roller 108 which drives the platen 44 is mounted on an appendage of the camming lever 138. The plunger or piston 58 is provided with a roller 140 which is driven directly by a camming surface 141 on one face of the lever 138, during the period from $t_1$ to time $t_2$. A L-shaped return lever 144, provided with arms 143 and 145, is pivotally mounted at 146 to a stationary flange 148 off the side wall 36 of the frame 32. At the time $t_2$ illustrated at FIG. 11 the camming surface 142 of the camming lever 138 loses contact with the roller 140. Nearly simultaneously the camming surface 142 comes in contact with the end of the arm 143 of the lever 144, driving the lever 144 such that its other arm 145 in turn drives the roller 140 and hence the plunger or piston 58 back away from the partly folded can **12*b***.

As seen in FIG. 12, the platen 44 continues advancing as described with respect to FIG. 9 of the previous example, until at time $t_3$ it completely crushes the can. A spring 149, may be provided to keep the piston or plunger 58 from moving with respect to the frame 32 after the camming surface 142 has lost contact with the lever 144. However, the spring 149 is not as critical and needs not be as stiff as the spring 98 of the previous example since its function is primarily static.

FIGS. 14–18 depict a further modification of the can folding mechanisms of the present invention incorporating several further refinements. Similarly to the two mechanisms described above, the motor 26 drives through the main timing shaft 64 a roller 108 eccentrically mounted to the shaft by means of a main drive lever 190. The roller 108 in turn drives the reciprocable platen 44 as previously described in detail through the slide assembly 110. A modified guide 115' is shown, FIG. 18, in which the slide assembly 110 and the posts 112 are more securely held during the operation of the can folder, said guide comprising a pair of U-shaped channels 189 each secured between a pair of braces 191.

Unlike the camming lever 138 of FIGS. 10–12, which directly drives the piston or plunger 58 into the can, the main drive lever 190 of the modified structure of FIGS. 14–18 experiences a reduced maximum load since the plunger 58 is driven indirectly through an intermediate lever 192 mounted, by means of a bolt or pin 194, to a flange off one of the frame side wall 36 or, as shown, to a plate 196 extending between the frame side walls 36 below levers 190 and 192. The plate 196 may be welded at each end, as shown at 198 at FIG. 18, to the top of a block 200 bolted to the frame side wall 36. As in the previously described mechanism, a two armed return lever 144 is also shown mounted to the plate 196 by means of a screw bolt or pin 202.

As is apparent from the drawing, the main drive lever 190 is driven counterclockwise and is provided with finger 204 encountering intermediate lever 192 and driving the end of the lever 192 against a roller 206 mounted below the plunger 58, thereby advancing the plunger 58 into the can 12. For convenience of illustration the roller 206 is not shown in FIG. 18 and is shown as if above the plunger 58 in the schematic representation of FIGS. 14–16. The opposite side of the roller 206 drives one arm 208 of the return lever 144, thus driving the return lever 144 counterclockwise until at the time shown in FIG. 15, the arm 204 of the lever 190 loses contact with the lever 192. Nearly simultaneously the arm 204 of the lever 190 comes in contact with a roller 210 on the end of a second arm 212 of the lever 144, driving the lever 144 clockwise and thus indirectly driving both the plunger 58 and the intermediate lever 192 back to their initial rest position. A spring, not shown, may be provided to bias the lever 144 against the roller 206.

The cans 12 may be manually fed into the can folding compartment 46 for either of the examples of structure heretofore described but preferably they are fed one at a time by an indexing mechanism such as that of the indexing unit 14 shown at FIGS. 2 and 5. The indexing unit 14 consists of a rectangular outer shroud 150 containing therewithin a first downwardly inclined surface 151 open at its lowermost end 154 and a second downwardly inclined surface 156 subjacent thereto and also open at its lowermost end. The second surface 156 is located at a skewed angle with respect to the first downwardly inclined surface 152 such that the high end of surface 156 lies below the opening at 154. A third inclined surface 158 may be provided above and parallel to the surface 156 and fastened to surface 152. As shown in the drawing, the three inclined surfaces 152, 154 and 156 define a continuous path or a queue for a number of cylindrical cans.

Figure 5A:
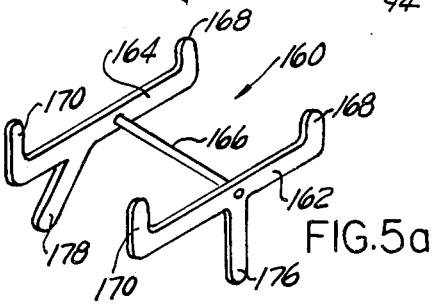
FIG. 5*a* is a perspective view of the wishbone lever assembly of the indexing can feed mechanism of FIG. 5.

A can indexing mechanism 160, as best shown at FIGS. 5–5*a*, comprises a pair of Y-shaped wishbone levers 162 and 164 mounted on a common pivot shaft 166 below the lowest inclined plane 156 such that the levers 162 and 164 are constrained to pivot in unison. Each of the levers has a first back finger 168 and a second front finger 170, at least one of which fingers is always projecting above the surface 156 through apertures 172 and 174 respectively, FIG. 5. While the fingers 168 and 170 of the two wishbone levers are aligned parallel to each other, the legs 176 and 178 of the levers are, as shown, at skewed angles with respect to each other. When the platen 44 and hence the plate 116, as previously described, are driven forward, the edge 180 of one of a pair of slots 182 in the plate 116 drives the leg 176 of lever 162 forward. Similarly while the platen 44 is being retracted, the edge of the other slot 182 drives the leg 178 of lever 164 back.

Thus, at $t_1$ when the platen 44 and the plunger 58 are fully retracted the levers 162 and 164 are displaced to the position shown at FIG. 5 in dotted lines at 162' and 164', the rearward fingers 168 are protruding through the apertures 172 of inclined surface 156 preventing advance of the next can 12 in the column of cans in the queue shown at 184. As the platen 44 and thus the edge 180 of the slot 182 are advanced, the wishbone levers 162 and 164 are pivoted on shaft 166, resulting in the emergence of the forward fingers 170 and the retraction of the rearward fingers 168 through the slots 174 and 172, respectively. The can in position 184, as well as the column of cans in the queue above it, is released and the can in the position 184 is advanced by gravity to position 186. At time $t_3$, shown in solid line in the drawing, the platen 44 begins to retract driving the wishbone levers 162 and 164 back to their original position shown in dotted line. Thus the forwardmost fingers 170 retract and the rearmost fingers 168 emerge through the slots 172 and 174. The can in position 186 advances to position 188 from which it is gravity fed through the opening 50 into the folding compartment 46. The back fingers 168 meanwhile temporarily prevent the advance of the next can, now in position 184, and of the column of cans above it.

Figure 15A:
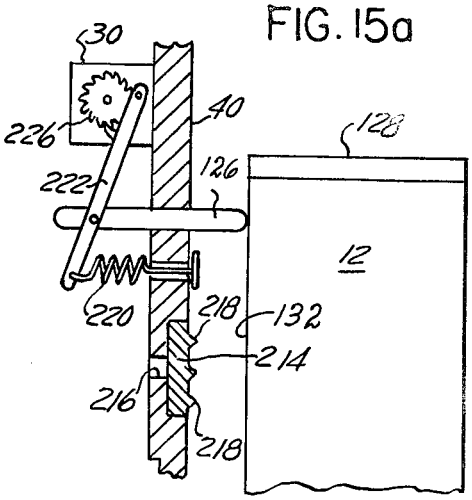
FIG. 15*a* is an enlarged detailed view of a portion of FIG. 15 but showing the can cancellation feature in detail.
Figure 14:
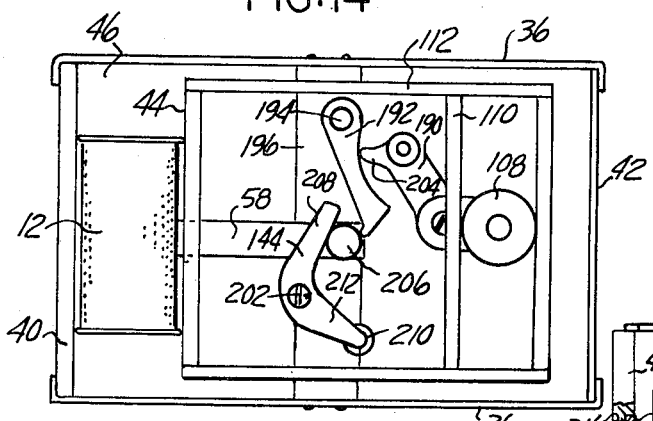
FIGS. 14, 15 and 16 are partly schematic top plan views of the can folding mechanism similar to FIGS. 7, 8 and 9 respectively but showing a further modification thereof.
Figure 17:
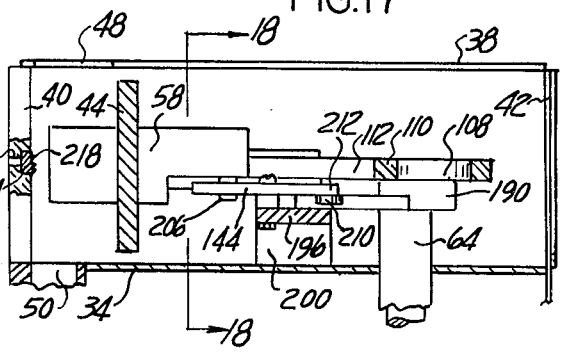
FIG. 17 is a partial cross-sectional view taken along line 17—17 of FIG. 15.
Figure 15:
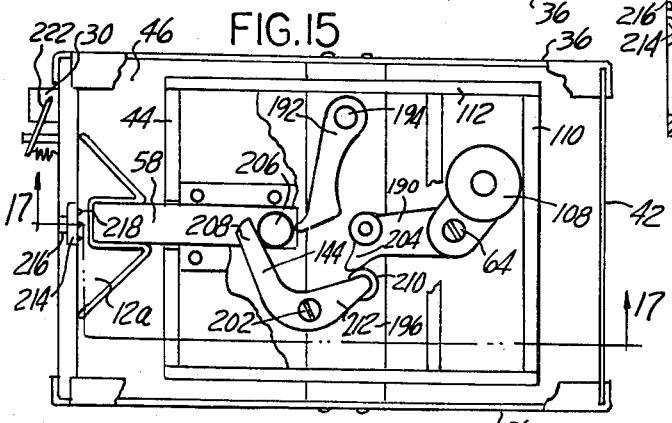
Figure 16:
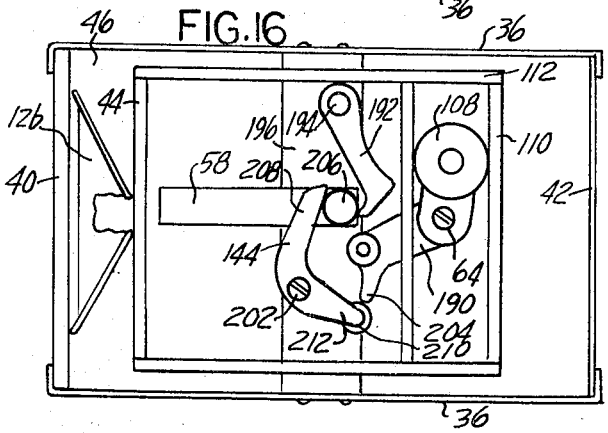
Figure 18:
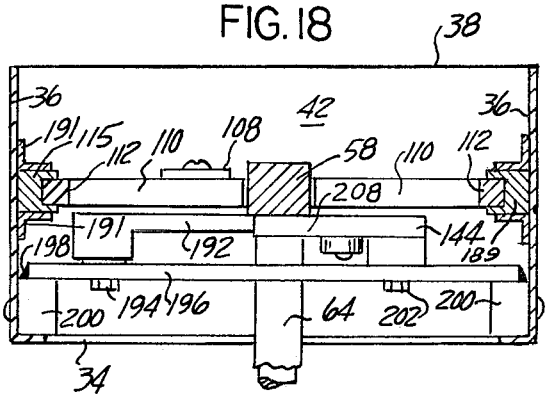
FIG. 18 is an enlarged cross-sectional view taken along line 18—18 of FIG. 17.
Figure 21:
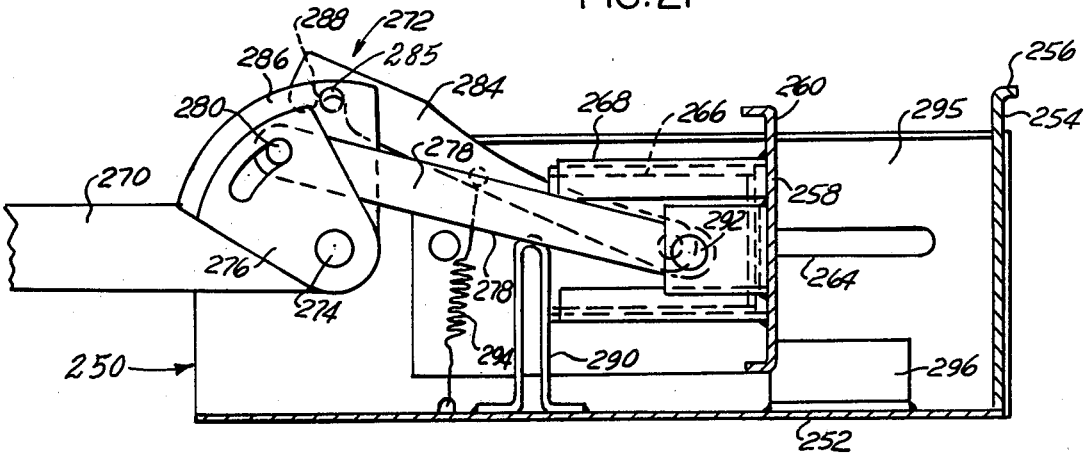
FIG. 21 is a cross-sectional side view taken through line 21—21 of FIG. 20 showing the can folding mechanism in its initial can loading position.
Figure 20:
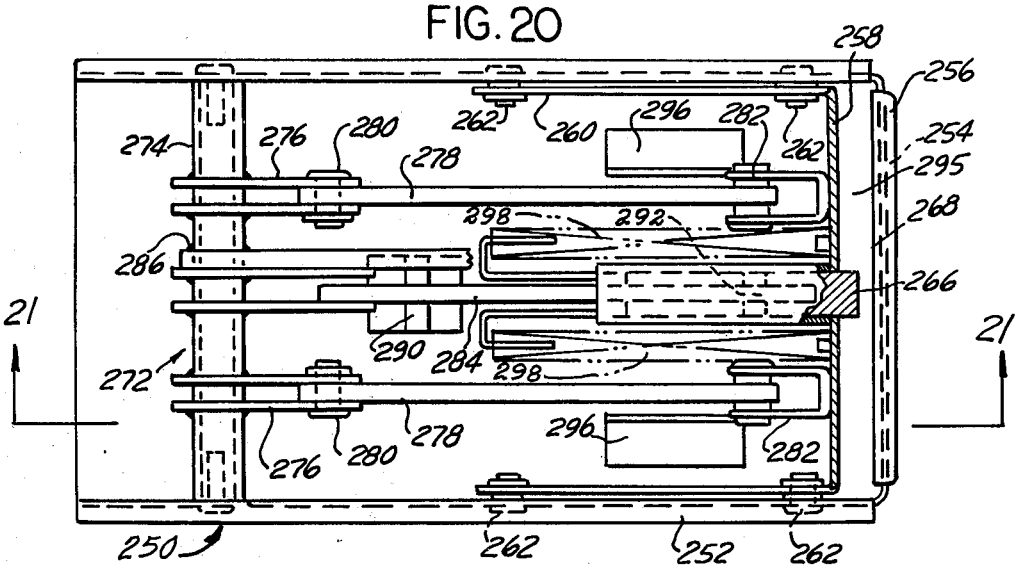
FIG. 20 is a top plan view of the manual can folding apparatus of FIG. 19, with portions broken away.
Figure 22:
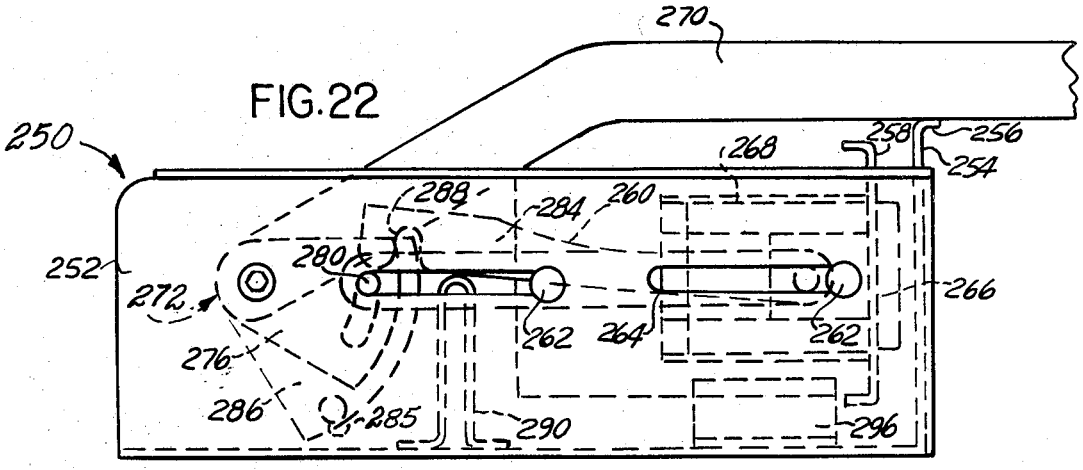
FIG. 22 is a schematic side view of the can folding mechanism of FIG. 19 in the final folding position.

As shown in FIGS. 15 and 17 and particularly in FIG. 15*a* the can folder may be provided with a branding or cancelling feature in accordance with the present invention to permit the retailer to identify the can as one for which a deposit has already been paid and to simplify the task of the wholesaler in identifying the retailer to whom the deposit is to be rebated. As shown in the cutaway portions of the drawing at FIG. 15*a*, a branding disk 214 is pressed into an enlarged portion of a bore 216 in the inside face of the anvil 40 as so to be substantially flush with the anvil 40 and aligned with the line of travel of the plunger 58. The disk 214 may be easily removed by inserting a knock-out pin through the smaller diameter portion of the bore 216 on the outside of the anvil 40 and tapping it with a hammer.

A number of sharp dimples or edges 218 are dispersed in an appropriate array or pattern on the surface of the disk 214 and extend beyond the surface of anvil 40 into the folding compartment 46 such as to leave a permanent and easily identifiable indentation on the can's cylindrical wall 132. The pattern may, for example, be a letter or be suggestive of a trademark or, alternatively, may be an entirely arbitrary symbol or arrangement of dots.

A means is provided to prevent the can 12 from remaining impalled on the disk 214 after the creasing and folding operation is completed. As best seen in FIG. 15*a*, a most convenient means consists in providing a spring 220 driving the plunger 126 of the digital counter 30 into the can. The plunger or actuator 126 and the spring 220 may be mounted proximate one end of a lever 222 pivotally mounted at its other end on a shaft through the counter 30 such that the advance of the platen 44 into the can 12 depresses the actuator 126 causing the lever 122 to pivot and a ratchet 224 within the counter to advance a gear, and thereby advance the register one digit. When the platen 44 retracts, the spring 220 drives the actuator 126 against the can, pushing it away from the disk 214, allowing the can to fall and the actuator and the ratchet to be restored to their rest positions.

Further variations of the can folder may be desired, depending on the type of user.

A can folder may, for a low volume restaurant user or for a home user, for example, be made as described above with or without an indexing feed mechanism and the counter but with the motor 26 and with the legs 22 and 24 omitted or shortened substantially. Instead, the end of drive shaft 64 would be provided with a coupling adapted to be driven by a motor permanently installed in the countertop, such as are currently commercially available, for example, under the tradename "Nutone", for driving such appliances as blenders, mixers, ice crushers, food processors and knife sharpeners, increasing the potential market for the can folder by thus reducing the space it takes up and its cost. If desired, a more unobvious rectangular sheet metal box or enclosure may be provided resembling that used on most major kitchen appliances and having appropriate accoustical insulation, an access door in front for removal of the folded cans 12*a*, and an aperture or a door in the top for loading empty cylindrical cans 12.

FIGS. 19–22 depict an example of a simplified manual version of a can folder 250 made according to the present invention for home use or for use in retail outlets where low volume of business in returnable beverage cans may not justify the cost of a fully or partly automated can folder. While the drawing shows an open box structure, safety and aesthetic considerations might dictate use of a permanent cover.

The manual can folder 250 is shown consisting of a stamped U-shaped frame 252 forming the bottom and two sides of the folder and a flat stationary anvil 254 preferably having a strengthening rib 256 at its top, which is secured to one end of the frame 252, forming the front wall of the folder. The flattening element consisting of a reciprocable platen 258 is formed from the front face of a U-shaped stamping 260 slidably mounted within the frame 252 by means of a pair of studs 262 passing through a circular aperture in the sides of the stamping 260 and a horizontal slot 264 in the side of the frame 252 such as to be constrained to travel a horizontal linear path. A reciprocable plunger 266 is independently slidably secured to the frame 252, by means of a guide bracket 268 such as to reciprocate through an aperture in the reciprocable platen 258 into and out of the folding compartment designated by numeral 295.

The platen 258 and plunger 266 are driven by a long manual lever 270 through a crank assembly 272 having a timing crankshaft 274, mounted between the sides of the frame 252. One or more slotted arms 276 drive one or more links 278 through pins 280. The link or links 278 are pinned at their other end to brackets 282 mounted to the platen 258. An additional link 284 is removably pinned at one end, as shown at 285 to a slotted arm 286 at a greater radial distance from the crankshaft 274 by means of a vertical slot 288 in the link 284. The other end of link 284 passes over an upset flange 290 mounted on the base of frame 252 and is connected by a pin 292 to the plunger 266. A spring 294, FIG. 21 mounted between the base of frame 252 and the middle of link 284 biases the link downwardly and thus keeps the pin 285 in slot 288.

The function of the manual can folder is similar to that of the motor driven folders previously described. At time $t_1$ shown in FIG. 21 an empty unfolded cylindrical can 12 is placed in the can folding compartment 295 between the anvil 254 and the reciprocable platen 258 and between a pair of adjustable can end face supports 296. Manual lever 272 is raised causing the crankshaft 274 to turn and thus eccentrically drives levers 278 and 284 to advance both the plunger 266 and the platen 258. The plunger 266 is advanced at a faster rate than the platen 258 due to the greater eccentricity of the pin 292. At time $t_2$, when the can has been appropriately creased in its center by the plunger 266, the upset flange 290 disengages the crank arm 284 from the crank arm 286 and one or more compression springs 298 retract the plunger 266 from the can, while the reciprocable platen 258 continues to advance until, at time $t_3$, it has completely folded and flattened the can.

As the operator manually returns the lever 270 to its original rest position, pin 292 on link 284 encounters slot 288 in the crank arm 286, thereby re-engaging the crank drive of the plunger 266 for the next stroke. As can be seen in the drawing, flange 290 may also act as a backstop for the plunger, arresting its motion and thus the furthest retreat of the crank assembly 272. If desired, provision may be made for temporarily disengaging the lever 284 during the entire folding cycle if, for example, an object other than a standard sized cylindrical beverage can is to be crushed.

The examples of structure of the can folding apparatus are given by way of illustration and not by way of limitation and may therefore be further modified according to the present invention.

The preceding disclosure constitutes a detailed description of the present invention by means of examples of structure illustrating the best modes contemplated at the time of filing for carrying out the invention, modifications whereof will be obvious to those skilled in the art.

What is claimed is:

1. A method for serially folding and flattening empty cylindrical cans each having a cylindrical sidewall and two circular end faces, said method comprising the steps of supporting one of said cans in a folding station between a flat stationary anvil and a flat reciprocable platen with the longitudinal axis of said can parallel to said anvil and said reciprocable platen, advancing a reciprocable creasing element through an aperture in said platen into the center of the cylindrical sidewall of said can and simultaneously advancing said platen towards said can until said creasing element has pressed the center portions of the opposite sides of said cylindrical sidewall into contact, rapidly retracting said creasing element from said can while continuing to advance said platen until the can circular end faces are substantially coplanar, and retracting said platen.

2. The method of claim 1 further comprising permanently branding said can, said branding being accomplished by said platen pressing said can against an array of sharp edges extending from the otherwise flat surface of said anvil.

3. The method of claim 1 further comprising mechanically counting said cans, said counting being accomplished by said platen engaging the actuating plunger of a mechanical counter.

4. The method of claim 1 further comprising feeding said cans one at a time into a compartment defining said folding station by means of an indexing feed mechanism, said indexing feed mechanism comprising an inclined surface sloping downwardly towards the top of said compartment, at least a first and a second position along said surface for a can, first retractable stop means arresting the gravitational advance of a can in said first position, second retractable stop means arresting the advance of said can in said second position, and means for alternatingly and sequentially retracting said two stop means.

5. The method of claim 1 wherein each of said cans is supported within said folding station by means of said anvil and said platen and by means of a first set of support rods supporting the bottom of said cylindrical wall and a second set of support rods supporting the end faces of said can.

6. The method of claim 1 wherein said platen is reciprocated by means of a driving shaft, a roller mounted eccentrically to said driving shaft so as to travel in an orbital path in a plane perpendicular to the face of said platen, and a frame attached at an end to said platen end engaged at its other end with said roller at two opposite points on the periphery of said roller, a frame guide constraining said frame to reciprocate in said orbital plane.

7. The method of claim 1 wherein said creasing element is advanced into said folding station by means of a driving shaft, a cam driven by said driving shaft and a linkage coupled to said creasing element and driven by said cam during a portion of the angular rotation of said driving shaft and disengaged from said cam during the remaining angular rotation of said shaft.

8. The method of claim 1 wherein said creasing element is driven into said folding station by means of a driving shaft, a cam driven by said driving shaft, and a cam follower mounted on the creasing element driven by said cam.

9. The method of claim 1 wherein said creasing element is driven into said folding station by means of a driving shaft, a main lever rotated by said driving shaft, an intermediate lever pivoted by said main lever during a portion of the angular rotation of said shaft, and a roller mounted to the creasing element and advanced by said intermediate lever.

10. The method of claim 1 wherein said creasing element is retracted from said folding station by means of a driving shaft, a cam on said driving shaft, a roller mounted to said creasing element and a two armed pivotable lever, one arm of said lever being driven by said cam and the other arm of said lever driving said roller.

11. The method of claim 1 wherein said creasing element is retracted from said folding station by means of a spring.

12. The method of claim 1 wherein said platen is reciprocated by means of a timing crankshaft having at least a first crankarm and link affixed at one end to said crankarm and at the other end to said platen, and wherein said creasing element is reciprocated by means of said timing crankshaft, a second crankarm mounted on said crankshaft, a second linkage removably pinned at one end to said crankarm and affixed at the other end to said creasing element, a spring biasing said creasing element away from said folding station, and means disengaging said second linkage from said second crankarm after said creasing element has advanced through said can.

13. An apparatus for folding an empty cylindrical can having a cylindrical sidewall, a circular top and a circular bottom, said apparatus comprising a flat stationary anvil, a reciprocable flattening element parallel to said anvil, a folding compartment between said anvil and said flattening element, an aperture through the center of said flattening element, an independently reciprocable creasing element passing through said aperture and into said folding compartment, means supporting said can within said folding compartment with the longitudinal axis thereof parallel to said anvil and said flattening element, a rotating timing shaft, means for advancing said creasing element and said flattening element towards said can during a first portion of the rotation of said timing shaft with said creasing element projecting from said flattening element such that said creasing element presses opposite sides of said can cylindrical wall into contact, first retracting means for rapidly retracting said creasing element from said can after said creasing element has advanced nearly through said can cylindrical wall, said first retracting means being actuated during a second portion of rotation of said timing shaft while said advancing means continues to advance said flattening element, and second retracting means for retracting said flattening element during a third portion of rotation of said timing shaft after said can is substantially flattened.

14. The apparatus of claim 13 wherein said first advancing means comprises a cam driven by said timing shaft, and a cam follower coupled to said creasing element, said cam being in contact with said cam follower only during said first portion of the rotation of said timing shaft.

15. The apparatus of claim 14 wherein said cam is a roller mounted eccentrically with respect to said timing shaft.

16. The apparatus of claim 14 wherein said cam follower is a roller mounted to said creasing element.

17. The apparatus of claim 14 wherein said cam follower is a linkage assembly, one end of said linkage assembly being driven by said cam and the other end driving said creasing element.

18. The apparatus of claim 13 wherein said advancing means comprises a crankarm on said timing shaft, a linkage having two ends, one end of said linkage being fastened to said creasing element and the other of said ends being removably pinned to said crankarm, means unpinning said creasing element from said linkage when said creasing element has advanced to its extreme position, and means repinning said creasing element to said linkage prior to further rotation of said timing shaft.

19. The apparatus of claim 13 wherein said advancing means comprises a roller, a pair of followers, said roller being mounted on an eccentric to said timing shaft, and said followers being located on two opposing sides of said roller and being rigidly connected to said flattening element.

20. The apparatus of claim 13 wherein said timing shaft is a crankshaft and wherein said advancing means comprises at least one crankarm, a first link connected between said crankarm and said creasing element and a second link removably connected between said crank-arm and said flattening element.

21. The apparatus of claim 13 further comprising a digital counter and a plunger activating said counter, said plunger being mounted on said anvil between said anvil and said flattening element such as to be depressed by the flattening element when it advances.

22. The apparatus of claim 13 further comprising indexing can feed means supporting at least two cans and depositing one can at a time into said folding station.

23. The apparatus of claim 22 wherein said indexing feed means comprises an inclined surface sloping downwardly towards the top of said folding station, at least a first and a second position along said surface for a can, first retractable stop means arresting the gravitational advance of a can in said first position, second retractable stop means arresting the advance of said can in said second position, and means for alternatingly and sequentially retracting said two stop means.

* * * * *

UNITED STATES PATENT AND TRADEMARK OFFICE

CERTIFICATE OF CORRECTION

PATENT NO. : 4,291,618

DATED : September 29, 1981

INVENTOR(S) : Warren R. Heiser et al

It is certified that error appears in the above-identified patent and that said Letters Patent are hereby corrected as shown below:

Column 7, line 55, change "151" to --152--.

Signed and Sealed this

*Nineteenth* Day of *January 1982*

[SEAL]

*Attest:*

GERALD J. MOSSINGHOFF

*Attesting Officer*

*Commissioner of Patents and Trademarks*